United States Patent [19]

Radford et al.

[11] Patent Number: 4,529,250

[45] Date of Patent: Jul. 16, 1985

[54] MINERAL MINING APPARATUS

[75] Inventors: Leonard Radford, Meersbrook; George Joel, Sheffield, both of England

[73] Assignee: Padley & Venables Limited, England

[21] Appl. No.: 464,856

[22] Filed: Feb. 8, 1983

[30] Foreign Application Priority Data

Feb. 9, 1982 [GB] United Kingdom ..... 8203638

[51] Int. Cl.[3] ..... E21B 10/60

[52] U.S. Cl. ..... 299/81; 175/393

[58] Field of Search ..... 299/81; 175/393

[56] References Cited

U.S. PATENT DOCUMENTS 2,119,349 5/1938 Pearce ..... 175/393

FOREIGN PATENT DOCUMENTS 2067625 7/1981 United Kingdom ..... 299/81

*Primary Examiner*—Stephen J. Novosad
*Assistant Examiner*—Michael A. Goodwin
*Attorney, Agent, or Firm*—Wigman & Cohen

[57] ABSTRACT

Mineral mining apparatus comprising a pick head 1 mounted on a pick holder 4 for displacement of a cutting part 5 in the direction of arrow A has a nozzle 9 in the head 1 through which nozzle water is sprayed for dust suppression, cooling or flushing purposes. The characteristics of the nozzle 9 provide the spray 22 with a flat configuration where the width y of the spray is greater than its depth x. Preferably the width y lies in the cutting plane 20 of the cutting part and the spray follows the cutting part to alleviate incendive sparking.

In a modification the nozzle 9 can be mounted on the holder 4.

20 Claims, 6 Drawing Figures

B y
x
23
5
6
22
19
15
1
A
9
16
20
4

MINERAL MINING APPARATUS

This invention relates to mineral mining apparatus and, more particularly, to a mineral mining pick (which term, as is generally acknowledged in the art, includes a pick for rock mining and road planing); a holder for a mineral mining pick, and the combination of a mineral mining pick and a holder. The pick holder is likely to be in the form of a socketed block or box on or in a rotatably driven drum of a mining machine but may be the drum itself.

In mineral mining with mechanically driven picks it is conventional practice, especially when coal cutting, to direct a fluid (which is usually water and will, for convenience, frequently be referred to as such hereinafter) into the cutting region of the picks for the primary purposes of dust suppression, flushing and cooling. Dust suppression and cooling is an internal discipline which many mineral mining (particularly coal) authorities have accepted in an attempt to reduce the incidence of respiratory diseases such as pneumoconiosis, and also to alleviate the possibility of local gas ignition and thereby the risk of explosion.

Cooling and dust suppression by applying a high pressure jet of water on to the mineral face in the cutting region is well known. In a conventional coal shearer drum an array of picks are secured in holding blocks which are helically spaced around the peripheral edge of a helical web or flange which is formed as part of the drum. The web or flange extends radially outwardly relative to the axis of the drum to serve as a screw conveyor for displacing coal or other mineral axially over the drum during its driven rotation and coal cutting. With this conventional arrangement the web or flange carries an array of nozzles through which the water is directed as a high pressure jet on to the cutting parts of picks which follow the jets from the respective nozzles during rotation of the drum in the intended direction of cutting.

It has also been proposed, for example by the disclosure in U.K. Pat. Specification No. 2,008,170, for water to be directed as a high pressure jet through an outlet port in the pick. With this arrangement a water passage within the pick body communicates between the outlet port and a source of water under pressure within the pick holder when the pick is mounted in the holder.

It is most important that the water which is used for dust suppression, flushing or cooling purposes is effectively applied so that the rate of water usage can be maintained at a minimum consistent with safety requirements. Too much water creates poor working conditions and problems in the transport and preparation of the mined mineral (especially coal). Therefore the water should be applied for optimum efficiency and it is a primary object of the present invention to provide mineral mining apparatus by which the water or other fluid can be utilised efficiently.

According to the present invention there is provided mineral mining apparatus carrying or adapted to carry a cutting part and comprising fluid passage means communicating with a nozzle means for directing fluid under pressure for dust suppression, cooling or flushing purposes during operation of the cutting part, and wherein said nozzle means is arranged to emit a spray of fluid which has a width in a plane extending laterally to the mean direction of the spray which is greater than the depth of the spray in that plane.

Broadly the present invention distinguishes from the prior proposals in that the water or other fluid is applied in, what may be regarded as, a generally flat spray as compared with a high pressure jet. Usually the spray, as viewed over its width, will be of fish-tail shape although other shapes can be provided such as fan shape or parallel sided. By the present invention the water is preferably emitted from the nozzle means as a fine spray which may itself develop into a mist or is caused to develop into a mist upon impact, for example against a mineral face; such a fine spray or mist is found to be efficient particularly for dust suppression and cooling purposes whilst using considerably less water than that which would be applied by a conventional high pressure jet. Furthermore, the relatively flat nature of the spray permits the nozzle means to be positioned so that the widthwise extent of the spray is orientated to provide a desired characteristic for dust suppression or cooling or to ensure that the water is directed where general working conditions are facilitated.

With mineral mining apparatus which carries a cutting part such as a pick, or which is adapted to carry a cutting part such as a pick holder, it is recognised that in use of such apparatus the cutting part will be intended for displacement in a cutting plane and preferably the nozzle means is located in that plane. Irrespective of whether or not the nozzle means is located in the cutting plane as aforementioned, it is preferred that the nozzle means is orientated so that the widthwise extent of its spray is substantially parallel to the cutting plane. This latter facility for determining the positioning of the generally flat spray is beneficial in so far as it can be used to improve the general working conditions for an operative of the apparatus. Frequently such an operative will stand alongside the apparatus which may comprise a rotary driven coal shearer drum and where the water is emitted as a conical spray or a high pressure jet it is not unusual for the operative to be drenched from the spray; the proposal to orientate the nozzle so that the widthwise extent of the spray is substantially parallel to the cutting plane alleviates the availability for the water to be directed over an operative who may be standing at the side of the apparatus.

The apparatus can be provided with several nozzle means and indeed this will usually be the case where such means are provided on a pick holder in the form of a rotatable drum as previously discussed. Where the nozzle means is located on the pick several such means can be provided to direct the spray as appropriate, usually forwardly and/or rearwardly with respect to the intended direction of movement of the cutting part.

The nozzle means can be integrally formed with the component which carries it but preferably it is formed as a separate integer which is carried by the said component to be replaceable.

The nozzle means may comprise an array of at least two outlet ports through each of which water is intended to be emitted to provide an array of fine jets which combine to form the spray. More preferably however the nozzle means comprises a port which communicates with the passage means and opens into a surface part the characteristics of which surface part are arranged to disperse the water emerging from the port to form the spray, especially the preferred fish-tail shaped spray.

A particular problem encountered in mineral, especially coal, mining is the danger of incendiary sparking caused by the emission of a trail of hot detritus or sparks as the cutting part or body of the pick adjacent to the cutting part engages the mineral face. The emission of such a trail of sparks can be extremely hazardous and to alleviate the risk of incendiary sparking it is a preferred feature of the present invention that the spray is emitted from the nozzle means to trail the cutting part in the intended direction of cutting motion for that part so that any sparks emitted as aforementioned enter the spray and are thus promptly cooled. In this way the spray may form a barrier or curtain through which the high temperature detritus must pass either through the depth or widthwise extent of the spray depending upon the orientation of the nozzle means. Preferably the nozzle means is arranged as aforementioned so that its widthwise extent is substantially parallel with the cutting plane so that the sparking detritus will follow a long path through the width of the spray while the depth of the spray alleviates the availability of water to fall on an operative positioned at the side of the apparatus.

FIGURES IN THE DRAWINGS

One embodiment of mineral mining apparatus constructed in accordance with the present invention will now be described, by way of example only, with reference to the accompanying illustrative drawings, in which.

DETAILED DESCRIPTION OF THE DRAWINGS

Figure 1:
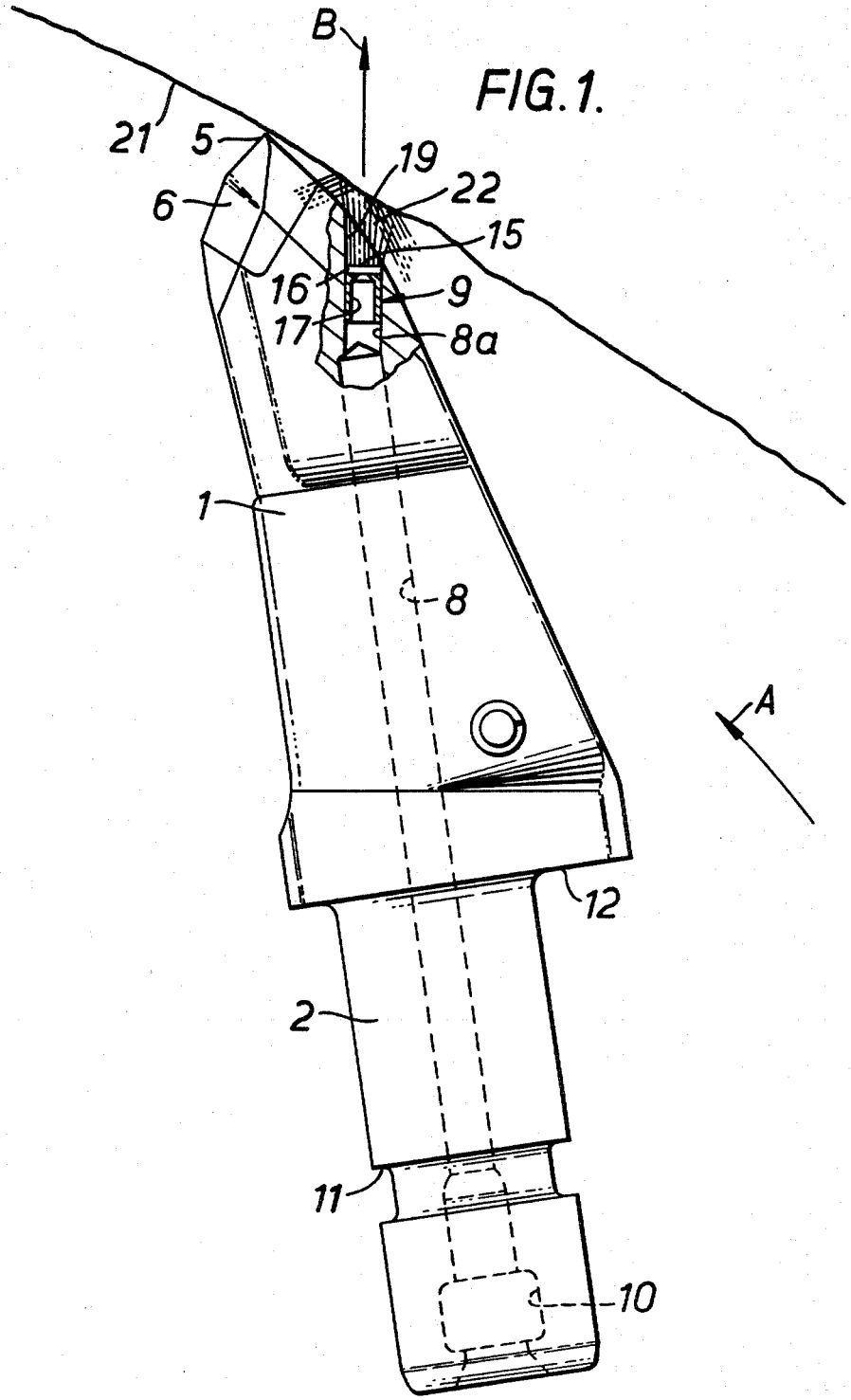
FIG. 1 is a side elevation of a pick in accordance with the invention, the pick head being shown in part section to illustrate a nozzle mounted therein.
Figure 2:
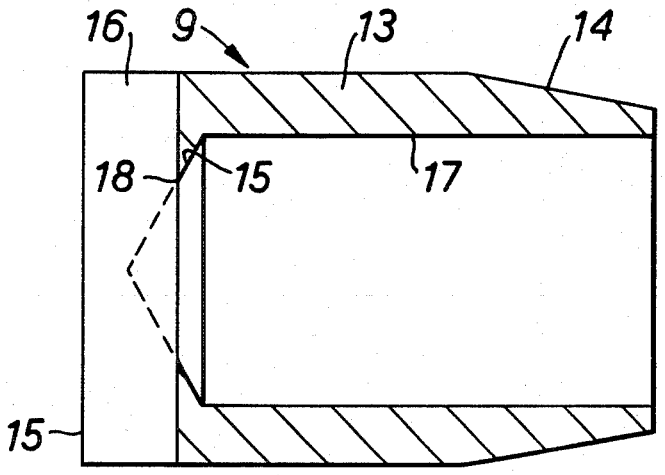
FIG. 2 is a sectional side elevation of a tubular component forming the nozzle of the pick in FIG. 1.
Figure 3:
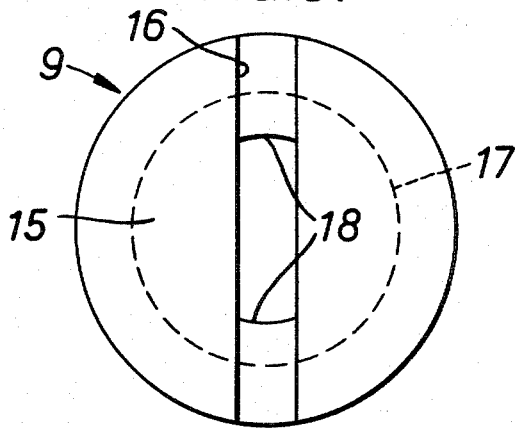
FIG. 3 is an end elevation of the nozzle in FIG. 2.

The mineral mining pick illustrated is primarily intended for coal mining and has a general appearance which may be regarded as conventional including a head 1 integrally formed with a longitudinally extending shank 2 by which latter the pick is intended to be mounted in a shank socket of a holder 4. The head 1 has a cutting part 5 which, as shown, will usually be formed by a hard material, such as tungsten carbide, insert 6 in the head.

The pick is provided with an internal passage 8 which extends longitudinally through the head 1 and shank 2 to provide communication between a nozzle 9 and a fluid coupling socket 10 opening from the free end of the shank. The socket 10 is intended to receive, in sealed manner, a tubular spigot (not shown) within the shank socket of the holder 4 as the shank 2 is inserted into the shank socket. The tubular spigot forms part of a fluid supply passage within the holder 4 through which water under pressure is fed into the passage 8 to be emitted through the nozzle 9 for the purposes of cooling, dust suppression or removal of detritus during use of the pick. The means for effecting communication between the passage 8 and the fluid supply passage is the subject of our co-pending U.K. patent application No. 81 33819, but it will be realised that alternative means for effecting such communication may be used.

Entry of the shank 2 into its shank socket is restricted by a shoulder 12 on the head 1 and the pick is conveniently retained in the shank socket by conventional retaining means on the holder engaging with a peripheral recess 11 on the shank.

Figure 4:
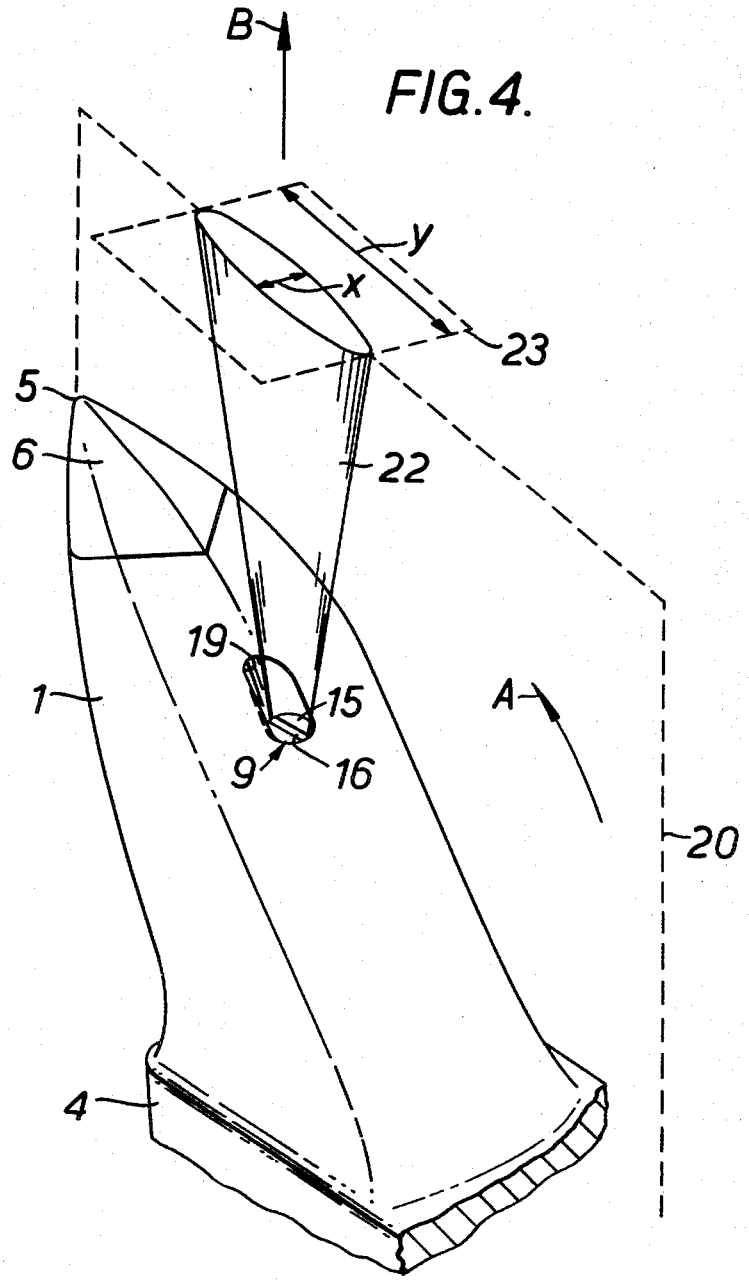
FIG. 4 is a sketch, in perspective, showing the pick of FIG. 1 mounted in a pick holder and illustrates a preferred arrangement for the spray.

The nozzle 9 is a generally tubular component, conveniently being formed in copper or brass or by injection moulding in plastics and comprises a cylindrical wall 13, the inner end of which is provided with an external frusto conical taper 14 to facilitate location of the nozzle within a complementary bore 8*a* formed as part of the internal passage 8. The outer end of the nozzle 9 has an end wall 15 within which is provided an elongated slot 16 which extends diametrically within the outer surface of the end wall. The bore 17 of the tubular component opens into the slot 16 to provide a relatively wide centrally positioned outlet port 18. The nozzle 9 is inserted into and retained in sealed manner in the bore 8*a* of the pick head, conveniently by a force fit, so that its bore 17 and outlet port 18 communicate with the water passage 8. As shown in FIGS. 1 and 4 the nozzle is generally located on the pick head in the cutting region with the outer surface of its end wall 15 protectively accommodated within a rebate 19 in the pick head.

For coal mining purposes the pick holder 4 will usually comprise a rotatably driven drum of a coal shearer while the shank socket within which the pick is mounted will usually be provided in a pick box or block secured for rotation with the drum. Upon rotation of the drum for mineral mining the pick will be displaced arcuately in the direction of arrow A for the cutting part 5 to attack the mineral face 21 and during such displacement the cutting part will move through a cutting plane 20 which extends in a radial plane from the axis of rotation of the drum. During engagement of the pick with the mineral face it frequently occurs that hot detritus breaks away to form a trail of sparks behind the cutting part 5 and this is particularly hazardous in an underground mining environment where an explosive atmosphere may exist. A particularly advantageous feature of the apparatus of the present embodiment is that it alleviates the possibility of incendiary sparking which could otherwise occur by the development of the sparks as aforementioned. From FIGS. 1 and 4 it will be noted that the nozzle 9 is located in the cutting region of the pick head adjacent to the cutting part 5 and to trail that cutting part during its movement in the direction of arrow A. More particularly, the nozzle is arranged to emit a fine spray of water under pressure supplied through the passage 8. This water spray indicated at 22 emerges from the pick head 1 in a mean direction shown by the arrow B and the nozzle is located so that the aforementioned mean direction of spray is substantially in the cutting plane 20. Furthermore, the characteristics of the nozzle 9 are such that the spray emitted therefrom is generally flat as indicated in FIG. 4 where the spray has a width y in a plane 23 which extends laterally to the mean direction B which is considerably greater than the depth x of the spray in that plane 23. The characteristics of the nozzle 9 in the present embodiment provide the spray with a generally "fish-tail" shape; this is believed to be due to the arrangement of the outlet port 18 with the slot 16 where water delivered through the outlet port is dispersed along the slot within the confines of the bore 8*a* so that the slot 16 determines the width and depth characteristics for the spray. By forming and locating a fine spray on the pick head as aforementioned, a trail of hot detritus emanating from the cutting part is intended to pass through the spray and cooled sufficiently to alleviate the possibility of incendiary sparking. With this fine spray arrangement the rate of water usage will be considerably less than that usually employed with conventional high pressure jets while the dispersal of the spray not only alleviates incendiary sparking but also provides efficient cooling of the pick head and efficient dust suppression to the extent that test picks made in accordance with the present embodiment have been found to possess far greater life than similar picks using conventional means of applying water for dust suppression or cooling purposes.

During fitting of the nozzle 9 it will be apparent that the orientation of the widthwise extent y of the spray will be determined by the orientation of the slot 16 with respect to the pick head (or more particularly to the bore 8*a* within which the nozzle is received). Consequently the nozzle may be fitted so that, for example, the widthwise extent y of the spray lies perpendicularly to the cutting plane 20; in this way the spray can provide a relatively wide shallow water curtain which follows the cutting part 5. Preferably however the nozzle 9 is orientated so that the widthwise extent y of its spray is substantially parallel to and is substantially in the cutting plane 20. This arrangement for the nozzle can be achieved by aligning the slot 16 with and in the cutting plane 20 as shown in FIG. 4 and is preferred for two main reasons; firstly, sparks emitted from the cutting part 5 tend to form a relatively narrow trail and the depth x of the spray need only be wide enough to engulf such sparks while the passage of the hot detritus through a relatively long path in the spray in the widthwise sense y ensures that adequate cooling of the detritus can be effected to alleviate incendiary sparking. It must also be borne in mind that usually the spray will impact against the mineral face 21 to increase the zone of its effectiveness and with a fine spray such impact may generate a mist which further improves cooling and dust suppression. Secondly, the restriction to the depth x of the water spray reduces the likelihood of excess water being directed axially of the drum and this is considered advantageous since it alleviates the drenching of an operative and generally improves working conditions.

Figure 5:
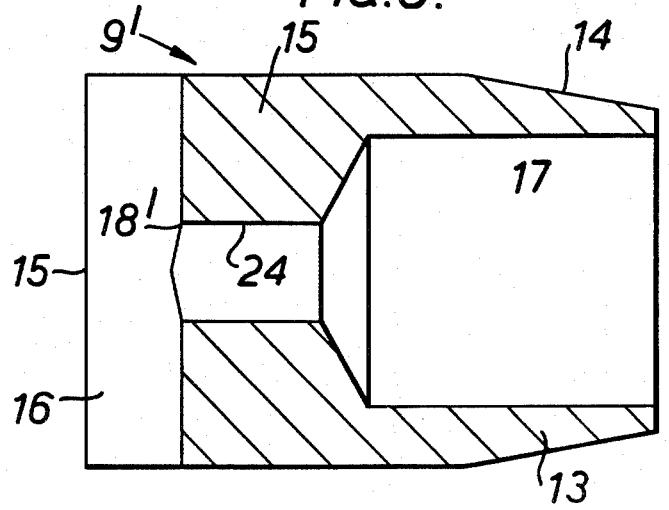
FIGS. 5 and 6 illustrate a modified form of nozzle suitable for use with the pick of FIG. 1, the modified nozzle being shown in views similar to the nozzle of FIGS. 2 and 3.
Figure 6:
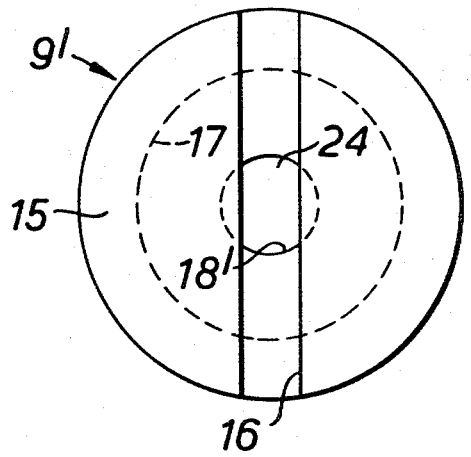

As previously mentioned the characteristics of the generally flat spray (which, incidentally, although frequently referred to as being flat will usually have an oval section as shown in FIG. 4) emitted from the nozzle can be varied by changing the characteristics of the nozzle. In particular we have found that the fineness of the spray from the nozzle of the present embodiment can be altered by varying the size of the outlet port 18. Accordingly there is shown in FIGS. 5 and 6 a modified nozzle 9' which may be used as an alternative to the nozzle 9. The nozzle 9' is generally similar to the nozzle 9 but differs in the manner in which the bore 17 communicates with the slot 16 in its end wall 15. From FIGS. 5 and 6 it will be seen that the bore 17 communicates with a considerably reduced bore 24 which opens into the slot 16 to provide a reduced outlet port 18'. We have found that flow of water under pressure through such a small outlet port 18' and the dispersement of the water along the slot 16 creates an extremely fine fluid spray which may almost be regarded as a mist but which nevertheless serves adequately for the purposes for which it is intended whilst reducing the rate of water usage.

In discussing the present invention we have referred to the trail of hot detritus or sparks which may develop from time-to-time during mineral cutting; it will be realised however that during normal usage of the apparatus the impact of the cutting part against the mineral face causes the mineral face forwardly of the cutting part to shatter while the dust formed by the grinding action of the cutting part trails behind that part. Accordingly the location of the fine spray behind the cutting part to trail that part in use can maximise the wetting of such dust and thereby create efficient dust suppression over a large area with minimum water consumption. This is contrary to the long held view that water should be directed to lead the cutting part during cutting and indeed it is likely that such leading high pressure water jets as have conventionally been provided can be omitted.

We claim:

1. Mineral mining apparatus, comprising:

a pick carrying or adapted to carry a cutting part displaceable in a cutting plane;

nozzle means for directing fluid under pressure for dust suppression, cooling or flushing purposes during operation of the cutting part;

fluid passage means in said pick for communicating with said nozzle means;

said nozzle means being arranged to emit a spray of fluid which has a width in a plane extending perpendicularly to the mean direction of the spray which is greater than the depth of the spray in said perpendicularly extending plane, the widthwise extent of the spray being substantially in the cutting plane of said cutting part, said pick having a body with a head mounting said cutting part, said nozzle means being located on the head of the pick for directing said spray to trail the cutting part of the pick when the pick is cutting.

2. Apparatus as claimed in claim 1 in which the cutting part is intended for displacement in a cutting plane and said nozzle means is located in that plane.

3. Apparatus as claimed in claim 1 in which the cutting part is intended for displacement in a cutting plane and said nozzle means is orientated so that the widthwise extent of the spray is substantially parallel to the cutting plane.

4. Apparatus as claimed in claim 1 in which the nozzle means is arranged to emit a spray which is substantially fish-tail shape.

5. Apparatus as claimed in claim 4 in which the nozzle means comprises an array of at least two outlet ports through each of which fluid is intended to be emitted to provide an array of fine jets which combine to form said spray.

6. Apparatus as claimed in claim 4 in which the nozzle means comprises a port communicating with said passage means, said port opening into a surface part of the nozzle means the characteristics of which surface part are arranged to disperse the fluid emerging from the port to form the fish-tail shaped spray.

7. Apparatus as claimed in claim 6 in which the surface of the nozzle means comprises an elongated slot with which said port communicates, the slot serving to disperse the fluid for the formation of the fish-tail shaped spray, the widthwise extent of said spray being substantially parallel with the longitudinal extent of said slot.

8. Apparatus as claimed in claim 7 in which the nozzle means comprises a tubular component received and secured within a bore of the fluid passage means and the bore of the tubular component opens into the elongated slot, said slot being formed in the surface of an end wall of the component.

9. Apparatus as claimed in claim 1 in which the nozzle means comprises a tubular component received and secured within a bore of the fluid passage means.

10. Apparatus as claimed in claim 9 in which the tubular component is secured as a force fit within said bore.

11. Apparatus as claimed in claim 1 and in the form of a holder for a pick, said holder having a shank socket for receiving a pick and carrying said nozzle means which communicates with fluid passage means within the holder.

12. Apparatus as claimed in claim 11 in which the nozzle means is located on the holder for directing its spray of fluid to trail the cutting part of a pick when mounted in the shank socket during displacement of the holder in the intended direction of use for the cutting part.

13. Apparatus as claimed in claim 11 which comprises the combination of the holder and a pick having a shank, said shank being received in the shank socket to mount the pick in the holder.

14. Apparatus as claimed in claim 13 in which the holder comprises a rotatable drum for displacing the cutting part arcuately in a cutting plane which extends perpendicularly to the rotational axis of the drum.

15. Apparatus as claimed in claim 1 and in the form of a pick which comprises a body having a head with a cutting part, said nozzle means being located on the head and communicating with fluid passage means in the body, said pick having a shank which is received in a shank socket of the holder to mount the pick and to provide communication between the fluid passage means in the pick and fluid supply passage means in the holder.

16. Apparatus as claimed in claim 15 in which the holder comprises a rotatable drum for displacing cutting part arcuately in the or a cutting plane which extends perpendicularly to the rotational axis of the drum.

17. A mineral mining apparatus, comprising:

a pick having a body with a cutting part displaceable in a cutting plane;

nozzle means located in said body adjacent the cutting part thereof and within the cutting plane for directing a pressurized spray of fluid in the cutting plane for dust suppression, cooling or flushing purposes during operation of the cutting part, said nozzle means comprising a narrow elongated slot for controlling the shape and direction of the spray such that the width of the spray extending in the direction of cutting is wider than the width of the spray extending transversely to the direction of cutting; and fluid passage means communicating with the nozzle means for supplying fluid to said nozzle means.

18. The apparatus of claim 17, wherein the nozzle means is arranged to emit a spray which is substantially fish-tail shaped.

19. The apparatus of claim 18, wherein the nozzle means comprises at least two outlet ports through each of which fluid is emitted to provide an array of fine jets which combine to form said spray.

20. The apparatus of claim 17 wherein said nozzle means comprises a first cylindrical bore which is in alignment with and communicates with a second cylindrical bore of reduced diameter, which in turn communicates with the narrow slot for emitting the spray.

* * * * *